US008152499B2

(12) United States Patent
Brun et al.

(10) Patent No.: US 8,152,499 B2
(45) Date of Patent: Apr. 10, 2012

(54) ECCENTRIC SCREW PUMP

(75) Inventors: Esben Grønborg Brun, Ålborg (DK); Søren Hansen, Århus C (DK); Per Höjsgaard Andreasen, Randers (DK); Helge Grann, Bjerringbro (DK)

(73) Assignee: Grundfos Management a/s, Bjerringbro (DK)

( * ) Notice: Subject to any disclaimer, the term of this patent is extended or adjusted under 35 U.S.C. 154(b) by 725 days.

(21) Appl. No.: 12/162,150

(22) PCT Filed: Jan. 25, 2007

(86) PCT No.: PCT/EP2007/000604

§ 371 (c)(1), (2), (4) Date: Dec. 5, 2008

(87) PCT Pub. No.: WO2007/085437

PCT Pub. Date: Aug. 2, 2007

(65) Prior Publication Data

US 2009/0214369 A1 Aug. 27, 2009

(30) Foreign Application Priority Data

Jan. 26, 2006 (EP) ..... 06001518

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 18/00*** | (2006.01) |
| ***F04C 2/00*** | (2006.01) |

(52) U.S. Cl. ..... 418/48; 418/152; 418/153

(58) Field of Classification Search ..... 418/48, 418/152, 153

See application file for complete search history.

(56) References Cited

U.S. PATENT DOCUMENTS

| | | | | |
|---|---|---|---|---|
| 2,527,673 | A * | 10/1950 | Byram | 418/48 |
| 2,733,854 | A * | 2/1956 | Chang | 418/48 |
| 2,957,427 | A * | 10/1960 | O'Connor | 418/48 |
| RE29,626 | E * | 5/1978 | Allen | 418/48 |
| 6,354,824 | B1 * | 3/2002 | Mills | 418/152 |

FOREIGN PATENT DOCUMENTS

| | | | |
|---|---|---|---|
| EP | 1503034 | A1 * | 2/2005 |
| FR | 1284388 | A * | 1/1962 |
| GB | 1583582 | A * | 1/1981 |

* cited by examiner

*Primary Examiner* — Theresa Trieu

(74) *Attorney, Agent, or Firm* — Panitch Schwarze Belisario & Nadel LLP

(57) ABSTRACT

An eccentric screw pump with an annular outer part (10; 40; 74) and an inner part (12; 42; 72) arranged therein has an interior of the outer part (10; 40; 74) and an exterior of the inner part (12; 42; 72) tapering in a complementary manner towards an axial end (16; 46; 70). In the axial direction (X, W), the inner part (12; 42; 72) and the outer part (10; 40; 74) are movably received in relation to each other and the inner part (12; 42; 72) and/or the outer part (10; 40; 74) are configured in such a manner that pressure applied to the pressure side of the eccentric screw pump generates a force that acts upon the inner part (12; 42; 72) axially to the direction in which the inner part (12; 42; 72) tapers and/or a force that acts upon the outer part (10; 40; 74) in an opposite axial direction.

12 Claims, 7 Drawing Sheets

ECCENTRIC SCREW PUMP

FIELD OF THE INVENTION

The invention relates to an eccentric screw pump. Eccentric screw pumps which are also known under the description Moineau pumps, comprise a screw-like rotor which runs eccentrically in a surrounding stator on rotation. Thereby, pumps are known with which the stator and the rotor have a constant cross section over their axial length.

BACKGROUND OF THE INVENTION

For example, an eccentric screw pump which comprises a conical rotor which runs in a conically designed stator, is known from U.S. Pat. No. 2,957,427. With this arrangement, it is possible to set the fit and the pressing force between the rotor and stator by way of axially displacing the rotor relative to the stator.

An adequate pressing force between the stator and the rotor is important, in order to ensure the sealedness of the pump at high pressures. Simultaneously, the fit should not be too tight, in order to keep the friction in the pump at low levels.

SUMMARY OF THE INVENTION

It is therefore the object of the invention, to provide an eccentric screw pump which permits an improved setting of the fit between the rotor and stator, so that an adequate sealedness at the contact surfaces between the rotor and the stator is always given, and simultaneously the friction between the rotor and the stator may be kept as low as possible.

This object is achieved by an eccentric screw pump with the features specified in at least one independent claim. Preferred embodiments are to be deduced from the dependent claims, the subsequent description as well as the drawings.

The eccentric screw pump according to the invention comprises an annular outer part with an inner part arranged therein. The inner part and the outer part move in the known manner relative to one another, wherein the pump movement is achieved. Thus the inner part may be designed as a rotor which rotates in the outer part, which forms a stationary stator. Thereby, the rotor and the stator simultaneously execute an eccentric movement to one another, wherein this eccentric movement may either be carried out by the rotor and/or by the stator. Alternatively, it is also possible for the outer part to rotate about the stationary inner part, which then serves as a stator. Thereby, again the eccentric movement may either be carried out by the rotating outer part or the stationary, i.e. non-rotating inner part. Alternatively, it is further also possible for the inner part as well as the outer part to rotate to one another, in order to carry out the relative movement to one another. The eccentric movement occurring on operation may also be realized by the inner part and the outer part simultaneously, instead of only one of the two parts carrying out the eccentric movement. Inasmuch as this is concerned, all conceivable drive combinations which are known of such pumps may be applied with the eccentric screw pump according to the invention.

With the eccentric screw pump according to the invention, the inside of the outer part and the outside of the inner part are designed in a manner such that they taper towards an axial side in a complementary manner, i.e. are preferably designed conically in the axial direction. This arrangement, when the inner part is pressed in the direction of the tapering end further into the surrounding outer part, permits the fit between the inner part and the outer part to be reduced, and the pressing pressure at the contact surfaces between the inner part and outer part to be increased. In this manner, the fit or the pressing pressure on the contact surfaces between the inner part and outer part may be set by way of the relative axial movement between the inner part and the outer part. For this, the inner part and outer part are mounted movable relative to one another in the axial direction, and specifically such that the movement ability is also given on operation of the pump, i.e. e.g. on rotation of the inner part.

Moreover, according to the invention, the inner part and/or outer part are designed in a manner such that the pressing pressure between the inner part and the outer part is increased with an increased pressure in the pump or with an increasing pressure on the pressure side of the pump. This means that with the pump according to the invention, the fit or the pressing pressure between the inner part and the outer part automatically sets itself on operation, wherein by way of the greater pressing pressure on the pressure side of the pump, an adequate sealedness of the pump is ensured, even with a high pump pressure. Moreover, it is also rendered possible for the pressing pressure at the contact surfaces between the inner part and the outer part to be reduced given a lower pressure on the pressure side, so that the friction is reduced. In this manner, given different pump pressures, it is possible to keep the friction as low as possible and to simultaneously keep the pressing pressure between the inner part and outer part as large as is necessary.

This manner of functioning according to the invention is realized by way of the inner part and/or outer part being designed in a manner such that a pressure prevailing at the pressure side of the eccentric screw pump and/or in the cavities of the eccentric screw pump between the inner part and outer part, is used in order to produce a force which presses the inner part and outer part into one another in the axial direction. This means that this force produced by the pressure on the pressure side or in the cavities, acts in the axial direction, in which the inner part and the outer part taper onto the inner part, or in the direction in which the inner part and outer part widen onto the outer part. Designs with which the pressure acts on the outer part as well as in the opposite direction on the inner part, are also conceivable. With each of these arrangements, it is ensured that forces are produced on account of the pressure prevailing on the pressure side or the cavities in the inside of the pump, which act onto the inner part and/or the outer part and press these into one another, in order to set the pressing pressure between the inner part and the outer part depending on the pressure on the pressure side or in the inside. Thus the differential pressure between the suction side and the pressure side of the eccentric screw pumps, i.e. between the two axial ends of the inner part and outer part or between the suction side and the cavities in the inside, is used to press the inner part and the outer part together. With a reduction of the pressure, the inner part and outer part move apart again in a preferably automatic manner on account of the pressure prevailing in the pump, or the pressure prevailing in the pump automatically reduces the pressing pressure between the inner part and the outer part, if it counteracts the forces acting from the outside.

Preferably, the eccentric screw pump is designed in a manner such that the pressure prevailing on the pressure side acts on a surface of the inner part, which is distant to the tapered end of the inner part. By way of the pressure impingement of this surface, an axial force acting in the direction of the tapering end of this surface is produced, which presses the inner part to the tapered end of the outer part. Furthermore, the size of the acting force may be influenced by way of the size of the surface on which the pressure acts in the axial direction, so that the force conditions, and in particular the region in which the pressing pressure between the inner part and outer part may vary, may be preset by way of adapting the surface. In particular, the surface is designed in relation to the remaining end-faces or end-sides of the inner part, onto which the pressure prevailing at the suction side or pressure side acts, in order to be able to preset the desired force conditions which act on the inner part.

The inner part and the outer part are further preferably arranged in a manner such that the axial side to which the inside of the outer part, and the outside of the inner part, taper, is the pressure side of the eccentric screw pump. The large cross section of the inner part and outer part at the opposite axial end accordingly forms the suction side of the pump. With this design, the pressure on the pressure side acts on the small end-face of the inner part. This force would thus press the inner part and the outer part apart, if no opposite force acts on the inner part and/or outer part. If then, the pressure prevailing at the pressure side simultaneously acts on a surface of the inner part which is distant to the pressure side, or however on a surface of the outer part which faces the pressure side, then the force acting on the small end-face of the inner part may be counteracted, in order to keep the inner part and outer part in bearing, even with a greater pressure difference between the suction side and the pressure side.

For this, with this embodiment with the eccentric screw pump, with which the tapered end of the inner part and outer part forms the pressure side of the pump, a channel is formed in the inside of the inner part, and this channel is open to the pressure side or to a cavity in the inside of the eccentric screw pump and is in connection with a surface of the inner part which is distant to the pressure side. In this manner, the pressure prevailing on the pressure side or the pressure prevailing in the inside of the pump, is led onto a surface which is distant to the pressure side, in order to produce a force there, which is directed axially opposite to the force acting on this on the pressure side of the inner part, and maintains the inner part bearing in the outer part, or pressing into the outer part.

Further preferably, for this, a pressure space is arranged on the axial side of the inner part, which is distant to the pressure side, and this pressure space is in connection with the mentioned channel. The pressure space has a length which may be changed in the axial direction and an inner surface which is distant to the pressure side and which is connected to the inner part. The pressure which is led via the channel into the pressure space and which prevails on the pressure side of the pump, leads to an extension of the pressure space and thus to a length change of the pressure space. The pressure thereby acts on an inner surface of the pressure space which is distant to the pressure side, and thus produces an axially directed pressure force on the inner part which presses this towards the tapered end of the inner part into the outer part, and ensures that an adequately high pressing pressure is maintained between the inner part and outer part, even with a greater pressure at the pressure side of the pump. The pressure space is preferably sealed with respect to the surroundings. This is particularly necessary, if the pressure space is arranged on the suction side of the pump in the axial extension of the inner part. With this preferred embodiment, one succeeds in the pressure prevailing on the pressure side also acting from the suction side onto an end-face or a surface of the inner part which faces the axial end-side. The inner surface of the pressure space, on which this pressure acts, is preferably firmly connected to the inner part or is coupled in movement in the axial direction to the inner part, in order to transmit the axially acting pressure force from the inner surface onto the inner part.

Particularly preferably, the pressure space is formed in the inside of a shaft driving the inner part, wherein the shaft with the pressure space may be changed in its length. The shaft connects a drive motor, preferably an electric drive motor, to the inner part. The inner part thereby forms a rotor, which rotates relative to the outer part, which functions preferably as a stator. The drive thereby is effected via the shaft which thus forms a rotor shaft. If the shaft is changeable in its length via the pressure space, then the pressing force between the inner part which is tapered to one side, preferably conical inner part, and the complementarily shaped inner surface of the outer part, may be set by the length change.

According to particularly preferred embodiments, the pressure space may be changed in its length via a piston-cylinder arrangement and/or by an outer wall which is elastic in the axial direction. The elastic outer wall may for example be designed in the manner of a bellows of metal, an elastomer or rubber. Simultaneously, one may realize a biasing on account of the elasticity. The piston-cylinder arrangement may also be realized by way of a multi-part design of the outer wall of the pressure space, wherein the parts of the outer wall of the pressure space engage in one another in a telescopic manner.

According to a further preferred embodiment, a throttle location may be formed in the channel or the pressure space which is in connection with the channel. This throttle location serves for damping pressure fluctuations which occur during operation of the pump, in order to prevent a change of the pressing pressure between the inner part and outer part, given brief pressure fluctuations. For this, the throttle location is arranged such that the transmission of the pressure from the pressure side of the inner part, to the surface of the inner part which is distant to the pressure side, or to the inner surface of the pressure space, is only effected in a damped manner via the throttle location, so that pressure changes in the pressure space are effected significantly more slowly than at the pressure side of the pump.

The surface which is distant to the pressure side, i.e. the distant, projected surface with which the channel is in connection, is preferably larger than the end-face of the inner part which faces the pressure side.

If the same pressure acts on the surface which is in connection with the channel and which is distant to the pressure side, for example the inner surface of the pressure space, as acts on the end-face of the inner part on the pressure side of the pump, then on account of the larger surface area, the force acting in the axial direction towards the pressure side on the inner part is larger than the force acting from the pressure side to the suction side in the axial direction. In this manner, it is ensured that independently of the pressure prevailing on the pressure side, the inner part is always impinged in the direction of the pressure side with a greater force, and is pressed into or against the outer part, if the pressure side is situated on the side of the tapered end of the inner part and outer part. The force pressing the inner part into the outer part is thus dependent on the area difference between the end-face of the inner part on the pressure side, and the surface distant to the pressure side, and proportional to the pressure on the pressure side of the pump or to the pressure difference between the suction side and the pressure side.

According to an alternative embodiment of the invention, the inner part and the outer part are arranged in a manner such that that axial side to which the inside of the outer part and the outside of the inner part taper, is the suction side of the eccentric screw pump. This means that the inner part and the inside of the outer part widen towards the pressure side of the pump. Since with this embodiment, the large end-face of the inner part is situated towards the pressure side, it is easily possible for the pressure prevailing on the pressure side to act on this surface, and thus to press the inner part into the outer part, and to always ensure an adequate pressing force at the contact points between the inner part and the outer part. The pressure acting at the suction side on the inner part is smaller, so that a lower force acts on the inner part at this side.

Preferably, with this embodiment, as well as the previously described embodiment, with which the tapered end of the inner part is situated on the pressure side, it is the case that the shaft driving the inner part engages at that end-side of the inner part, at which the greatest cross-sectional surface of the inner part is situated. Thereby, with the embodiment with which the inner part widens towards the pressure side, preferably at least one pressure surface which is distant to the suction side in the axial direction, i.e. faces the pressure side, and on which the pressure prevailing on the pressure side of the eccentric screw pump acts, is arranged on the inner part and/or on the shaft which is connected to the inner part on the axial side. By way of impinging this pressure surface, a pressure force is produced, which acts in the axial direction towards the suction side and thus toward the tapered end of the inner part and of the inner space of the outer part, and thus presses the inner part against the outer part.

Additionally, a pressure channel is provided with this embodiment, which connects the pressure side or a cavity in the inside of the eccentric screw pump, to a surface of the outer part which is distant to the pressure side. This is a surface which actually faces the suction side of the pump and which is impinged via the pressure channel with the pressure prevailing on the pressure side or in the inside between the inner part and outer part, so that the outer part is pressed onto the inner part from this side, on which the tapered end of the outer part is situated. A throttle location may be arranged in the pressure channel.

Further preferably, at least one biasing element is provided, which impinges the inner part with a biasing force in the axial direction in which it tapers and/or which impinges the outer part with a biasing force in the opposite axial direction. Such a biasing element may be applied with both previously described basic embodiments of the invention, i.e. independently of whether the pressure side is situated at the tapered end or at the widened end of the inner part. Such a biasing element or several such biasing elements have the effect that the inner part and the outer part are pressed against one another in the axial direction, so that the contact points or contact lines serving as sealing surfaces, are held in bearing between the inner part and the outer part. The biasing elements have the effect that an adequate pressing force is given between the inner part and outer part even, with an only slight pressure on the pressure side or with a low or non-existent pressure difference between the suction side and pressure side, so that the pump spaces formed in the inside are sealed and the function is ensured, even on starting up the pump.

The inner part is preferably connected via a shaft or rotor shaft to a drive motor, in particular to an electric drive motor, wherein the shaft is mounted in an articulated manner on a joint point, i.e. on the articulation point on the driven shaft of the drive motor, and the joint point is movable preferably in a purely rotational manner. This permits the inner part serving as a rotor to carry out an eccentric movement during its rotation, wherein the joint point itself rotates preferably only about a longitudinal axis and does not carry out an eccentric or axial movement in the direction of the longitudinal axis. This means that no eccentricity of the movement on the joint point itself is given. One may make do without additional joint elements in the shaft for permitting the eccentric movement, on account of the articulated design of the articulation pint. Alternatively, the rotor shaft may be designed in a flexible manner or be provided with a joint, so that an eccentric movement is possible about a fictive joint point.

Further preferably, the inner part is connected via a shaft to the drive motor, and the shaft together with the inner part may be moved in an eccentric manner, wherein the inner part and the shaft are arranged in a manner such that the eccentricity of their movement increases proceeding from a joint point, i.e. from the articulation point on the drive motor, preferably in a linear manner. As described above, no eccentricity additionally to the rotation movement of the shaft is given at the joint point. Proceeding from this point, the inner part and the shaft, apart from their rotation about their longitudinal axis, carry out an eccentric movement about the joint point and thereby, the longitudinal axis of the shaft preferably moves along a cone superficies surface, wherein the tip of the cone is situated in the joint point. This means that the shaft rolls over the cone superficies surface. Particularly preferably, the longitudinal axis of the inner part and the longitudinal axis of the shaft form a straight line which executes the described eccentric movement over the cone superficies surfaces about the joint point. In this manner, an eccentric movement of the inner part is achieved in the inside of the outer part, so that the inner part rolls on the inner surface of the outer part.

The inner part is preferably designed of a ceramic material at least on its surface, whilst the outer part at least on the surface facing the inner part is designed as an elastomer. Particularly preferably, the inner part is designed completely of a ceramic material, and the outer part is designed completely of an elastomer material. This means the inner part has a hard surface, whilst the outer part has an elastic surface facing the inner part.

DESCRIPTION OF THE DRAWINGS

The invention is hereinafter described by way of example and by way of the attached figures. In these there are shown in.

DETAILED DESCRIPTION

The subsequent embodiment examples relate to drive arrangement, with which the inner part of the pump is designed as a rotor and is driven in rotation. Accordingly, the outer part of the eccentric screw pump is designed as a non-rotating stator. I.e. the relative movement between the rotor and the stator is produced alone by the rotation of the rotor. However, it is to be understood that the principle on which the invention is based may be used for setting the fit between the rotor and the stator, also with arrangement with which the outer part, hereinafter described as a stator rotates, relative to the inner part.

Figure 1:
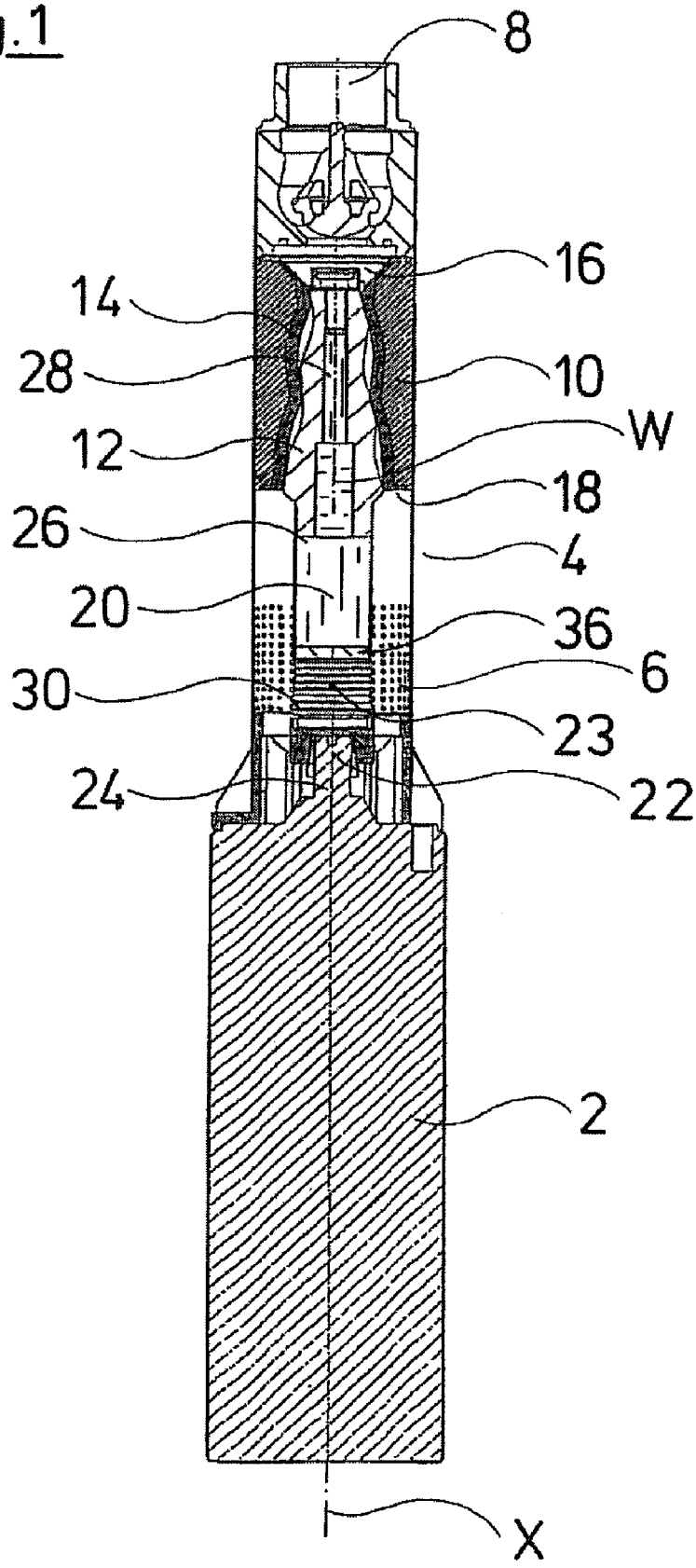
FIG. 1 a sectioned total view of a pump assembly according to the invention, FIG. 2 a sectioned view of the rotor and of the stator of a pump assembly according to FIG. 1, FIG. 3 a perspective view of the rotor, in a partly sectioned representation, FIG. 4 a schematic representation of the pressure conditions at the stator and rotor, FIG. 5 a sectioned view of an eccentric screw pump according to a second embodiments of the invention, FIG. 6 a sectioned view of the rotor and stator according to a third embodiment of the invention, and FIG. 7 a perceptively sectioned view of a fourth embodiment of the invention.
Figure 2:
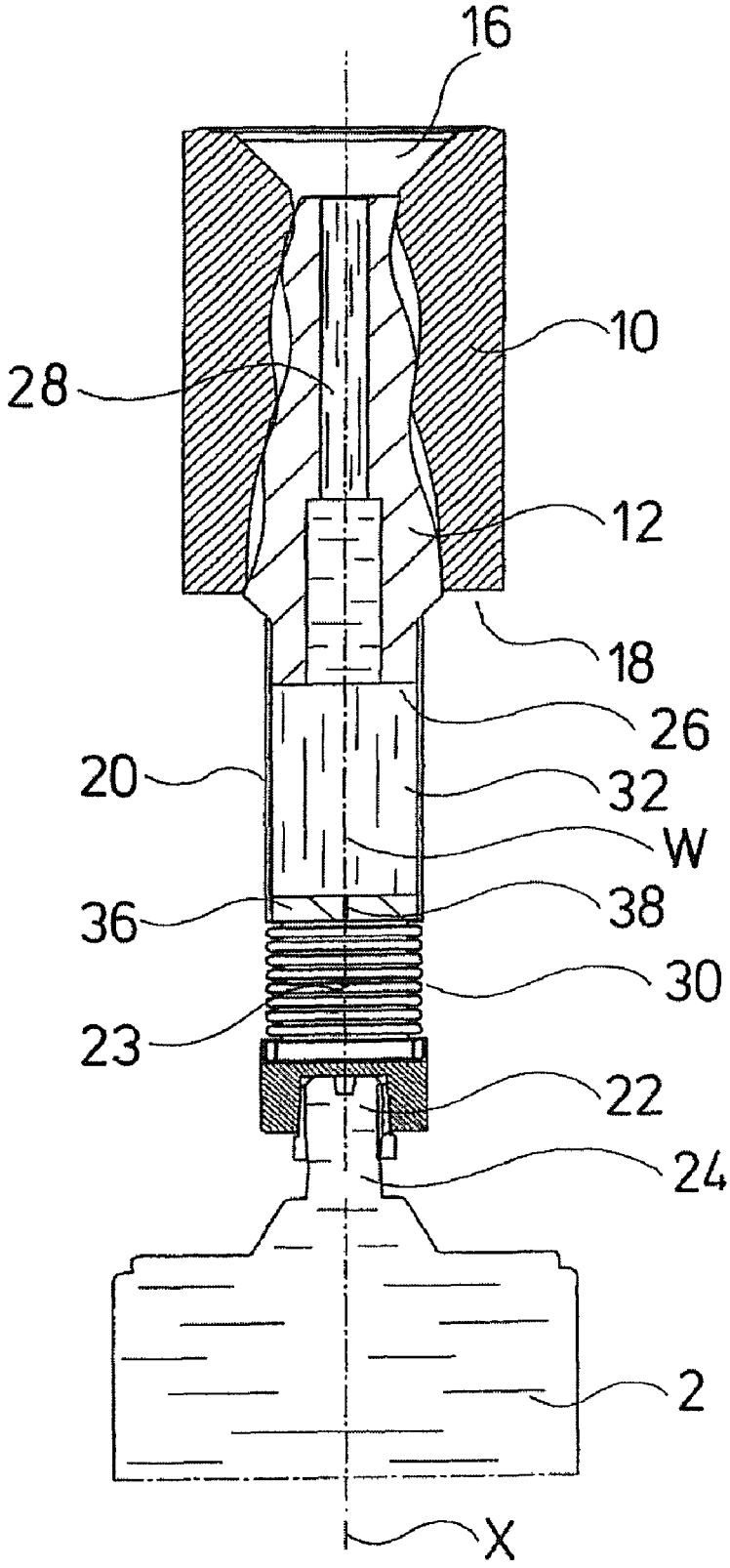

The eccentric screw pump represented in FIG. 1 is designed as a submersible pump, which at its lower end comprises an electric drive motor 2, on which the actual pump unit 4 is flanged in an axial manner. The pump unit 4 comprises peripheral entry openings 6 and a pressure union 8 at its upper, axial end in the direction of the longitudinal axis X. The eccentric screw pump arranged in the inside of the pump unit 4 comprises an annular stator 10, as well as a screw-like rotor 12 arranged in its inside. In the shown example, the stator inner side is coated with an elastomer material 14, which comes into contact with the outer surface of the rotor 12 at the contact locations. The rotor 12 is preferably designed of steel, in particular stainless steel or ceramic. The rotor 12 and the stator 10 in the known manner, form an eccentric screw pump or Moineau pump, with which the rotor 12 rotates in the inside of the stator 10 about its longitudinal axis. Thereby, the longitudinal axis simultaneously describes a circle movement about the stator longitudinal axis, i.e. the rotor rotates eccentrically in the stator 10. The pump effect is produced by way of the stator inner wall and the rotor inner wall having a different number of helical windings.

With the pump assembly shown in FIG. 1, the eccentric screw pump is designed in a conical manner, i.e. the stator 10 or the inner space of the stator 10, and the rotor 12, taper towards an axial end-side 16. The end-side 16 forms the pressure side of the pump, whilst the opposite end-side 18 of the stator 10 is situated on the suction side of the pump.

The rotor 12, via a rotor shaft 20 connecting to the end-side 18, at an articulation point 22, is connected to the driven shaft 24 of the drive motor 2.

The rotor shaft 20 is designed in an articulated manner, such that the rotor shaft 20 on its rotation additionally may carry out an eccentric movement. The flexibility of the rotor shaft 20 is realized by the bellows 30 on the end of the rotor shaft 20, which faces the drive motor 2, and which will be described later. This eccentric movement is effected in a manner such that a fictive joint point 23 on the longitudinal axis of the bellows 30 forms the tip of the cone, on whose surface the rotor shaft 20 with the rotor 12, moves eccentrically, whilst the rotor shaft 20 and the rotor 12 driven by the drive motor 2, rotate about their longitudinal axis. This means that the rotor 12 together with the rotor shaft 20 in the inside of the stator 14, carries out an eccentric movement which is effected in a conical manner about the longitudinal axis X and the joint point 23 in the bellows 30. The eccentricity results on account of the design of the stator 10 and rotor 12, so that the rotor 12 automatically carries out the described eccentric movement on rotation of the rotor about its own axis. The eccentric movement is effected such that the eccentricity is the greatest, i.e. the diameter of the circle on which the middle axis of the rotor moves on rotation is the greatest, at the end-side 16. Eccentricity is no longer given at the joint point 23 in the bellows 30. The rotor at the end-side 18 moves with a lower eccentricity than at the end-side 16, i.e. the diameter of the circle on which the middle axis of the rotor moves on its rotation, is smaller.

The eccentric screw pump according to the invention is designed such that the fit between the rotor 12 and the stator 10 is automatically set in dependence on the pressure conditions at the pressure side and the suction side of the eccentric screw pump, and in particular on the pressure difference between the pressure side and the suction side. This means that the pressing pressure at the contact surfaces between the rotor 12 and the stator 10 is adapted automatically in dependence on the fluid pressure.

Figure 3:
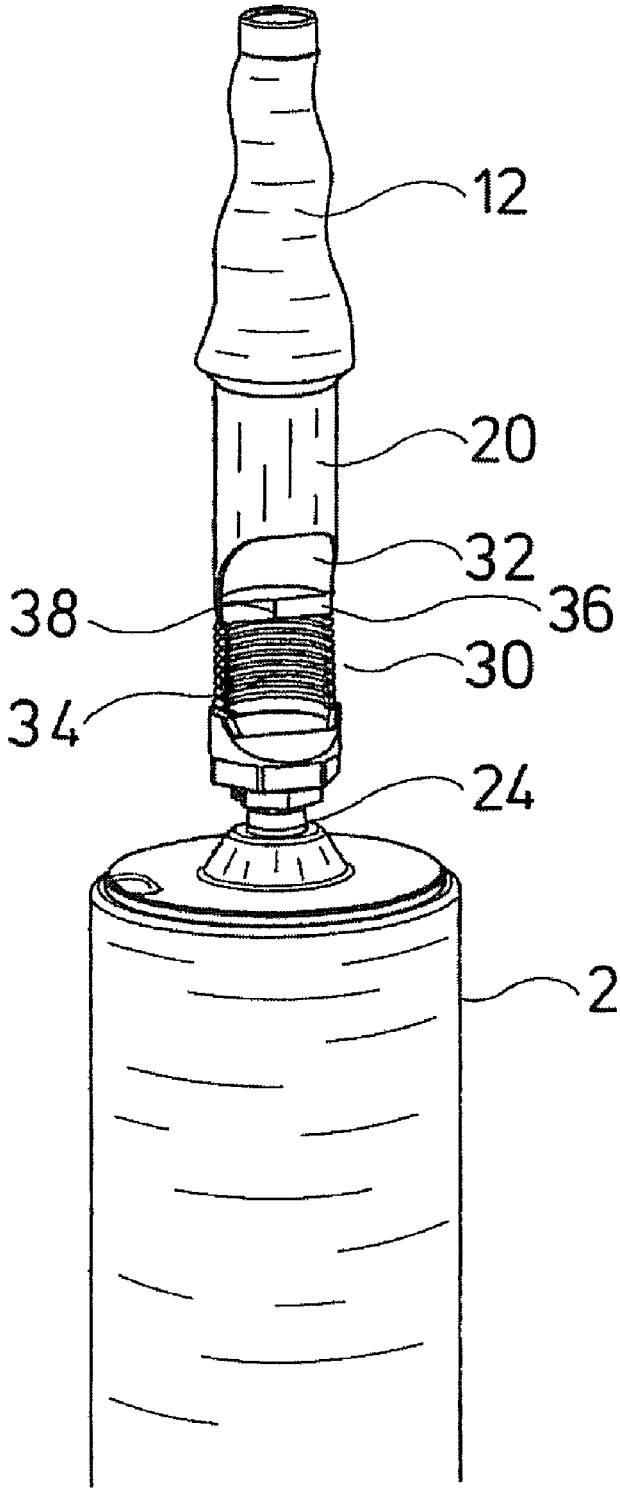
Figure 4:
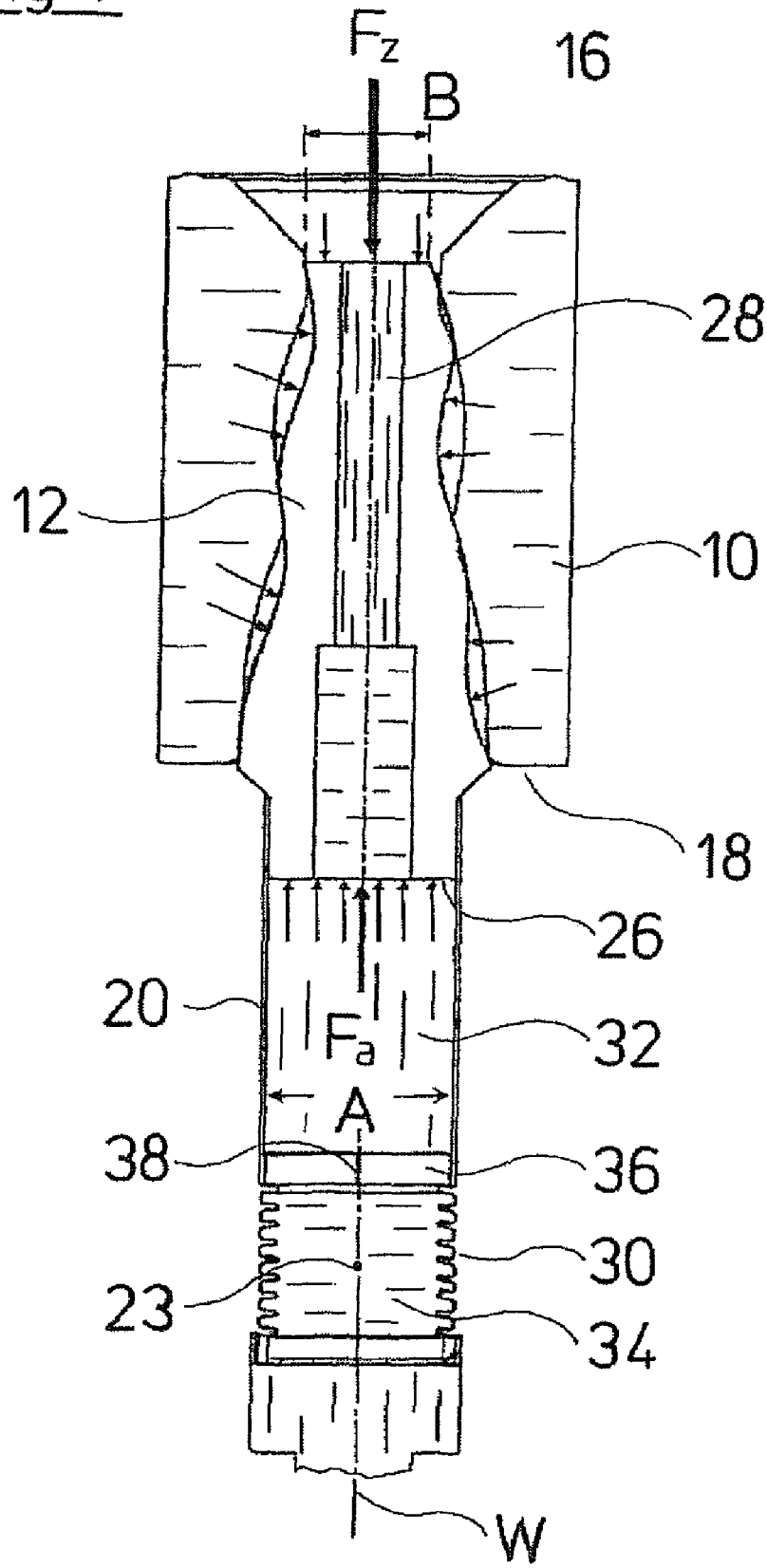

With the example shown in FIG. 1, this is effected by way of the fluid pressure prevailing on the pressure side, i.e. the end-side 16, acting on a pressure surface 26 facing the suction side, as is described in more detail by way of FIGS. 3 to 4.

The rotor 12 comprises a centrally arranged channel which extends in the longitudinal direction from the end-side 16 up to the pressure surface 26, which here forms the opposite end-side of the rotor 12. At the pressure surface 26, the channel 28 opens into the inside of the hollowly designed rotor shaft 20. Thus the fluid pressure bearing at the end-side 16, i.e. the pressure side of the eccentric screw pump, may be led through the channel 28 onto the pressure surface 26 which is distant to the end-side 16, i.e. the pressure side.

This leads to force conditions as are represented essentially in FIG. 4 by way of a detailed view. A force $F_z$ which is caused by the fluid pressure on the pressure side of the pump acts on the end-side of the rotor 12 which faces the end-side 16. This force $F_z$ is dependent on the size, i.e. the diameter B of the end-side of the rotor 12. Since the fluid pressure is led from the suction side through the channel 28, into the inside of the rotor shaft 20, a force $F_a$ is produced on the inner surface which faces the rotor 12 and which forms the pressure surface 26, by way of the fluid pressure bearing on the pressure side of the rotor 12. This force is moreover dependent on the size of the pressure surface 26, i.e. on the inner diameter A of the rotor shaft 20, which corresponds to the diameter of the pressure surface 26. Ideally, the pressure surface 26 is greater than the end-side surface of the rotor 12 at the end-side 16. This leads to the fact that the force $F_a$ is always greater than the force $F_z$, since the same pressure prevails on both sides, so that it is ensured that the rotor 12 is pressed into the stator 10 in the direction towards the end side 16. The pressing force acting in the axial direction thereby is the difference of the forces $F_a$ and $F_z$, i.e. the force which results from the surface area difference of the two end-sides of the rotor 12, multiplied by the fluid pressure prevailing at the pressure side, as well as the components from pressure conditions in the cavities between the rotor 12 and the stator 10. From this, it results that the pressing force between the rotor and stator increases with an increasing fluid pressure at the pressure side.

The rotor shaft 20 is designed such that an axial displaceability of the rotor 12 is given in the direction of the longitudinal axis W of the rotor 12 and the rotor shaft 20. This longitudinal displacement ability is likewise realized by the bellows 30, which forms an elastic wall of the rotor shaft 20. The bellows 30 may be designed of metal or plastic, in particular of an elastomer. Apart from the elasticity in the axial direction W, is must also have a torsional stiffness for transmitting the torque which acts on the rotor shaft 20, as well as a flexibility for the eccentric movement of the rotor 12. The rotor shaft 20 with the bellows 30 is designed in a hollow manner, so that a pressure space 32 and 34 is formed in the inside. The pressure space 32 thereby lies in the rigid part of the rotor shaft 20, the pressure space 34 lies in the part of the rotor shaft 20 which is formed by the bellows 30. The pressure spaces 32 and 34 are separated from one another by a separating wall 36. The separating wall 36 is arranged at the axial end of the rigid part of the rotor shaft 20, adjacent to the part formed by the bellows 30. The separating wall 36 comprises a channel, which extends between the two end-sides, and which connects the two pressure spaces 32 and 34 adjacent to the end-sides, to one another. The channel 38 forms a throttle location, by way of which the fluid which led through the channel 28 from the pressure side of the rotor 12, may flow from the pressure space 32 into the pressure space 34 and back. This throttle location periodically damps occurring pressure fluctuations which occur on operation of the eccentric screw pump, which is inherent of the design. In this manner, fluctuations of the pressing force Fa on account of the pressure fluctuations are eliminated. Only larger pressure fluctuations with a greater period lead to a change in the force Fa.

The bellows 30 on account of its elasticity, acts as a spring element in the axial direction, which produces a bias between the rotor 12 and the stator 10. On account of the elasticity of the bellows 30, the rotor 12 is pressed in the direction of the longitudinal axis W into the inside of the stator.

Figure 5:
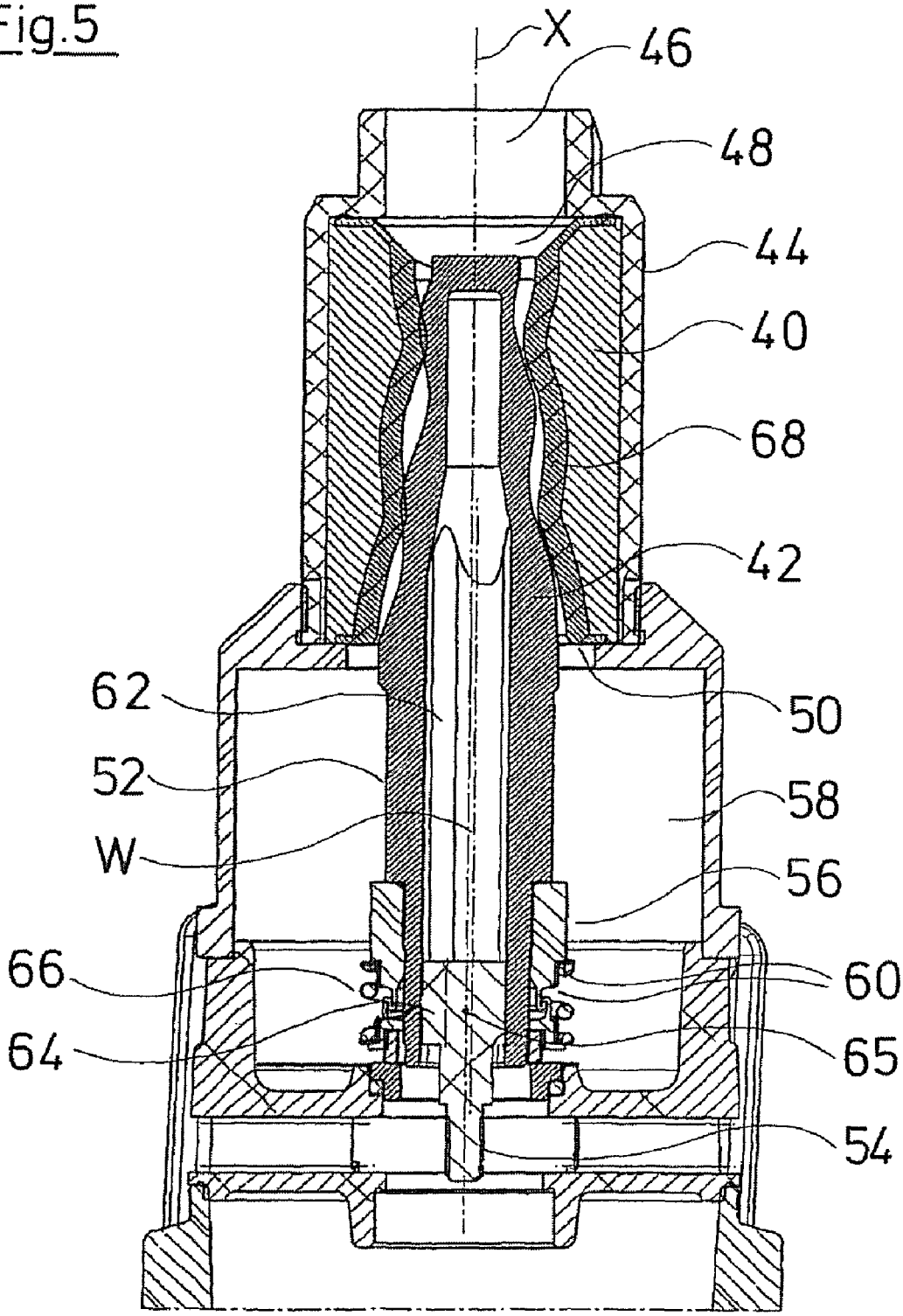

A second embodiment according to the invention is described by way of FIG. 5. This embodiment differs from the previously described embodiment in that here, the pressure side is situated at the end of the conically designed rotor, which has the largest diameter. Inasmuch as this is concerned, the arrangement is exactly the opposite of that previously described. With this embodiment, a pressure channel which is not shown in FIG. 5 is provided, which connects the pressure side to a surface of the stator 40, which faces the suction side.

The eccentric screw pump shown in FIG. 5 comprises a stator 40, in which a rotor 42 is arranged, wherein the stator 40 and the rotor 42 comprise the spiral-like surface design which is usual with eccentric screw pumps. The stator 40 is arranged in a housing 44, which at a first axial end comprises a suction opening 46, through which the fluid to be delivered penetrates into the pump. The suction opening 46 faces the end-side 48 of the stator 40 and the rotor 42, which has the smallest diameter. At the opposite end-side 50, the rotor 42 and the inside of the stator 40 have a larger diameter. The inside of the stator 40 and the outer periphery of the rotor 42 are thus designed in a conical manner. The end-side 50 faces the pressure side of the eccentric screw pump which is formed by the stator 40 and the rotor 42.

The rotor 42, on the axial side, merges into a rotor shaft 52, wherein here, the rotor 42 and the rotor shaft 52 are designed as an integral component. The rotor shaft 52 at its axial end 54 which is distant to the rotor 42, is connected to a motor shaft of a drive motor which is not shown here. With this embodiment form too, the rotor shaft 52 with the rotor 42 executes an eccentric movement in the inside of the stator 40, wherein the rotor shaft 52 on the one hand rotates about its longitudinal axis X, and on the other hand executes an eccentric movement about the longitudinal axis X of the stator 40. Thereby here, the rotor 42, as described with the first embodiment example, executes a movement with which the longitudinal axis W runs on the cone superficies surface on account of the conical design of the rotor 42 and the stator 40. Thereby, the tip of this cone is situated in the articulation point of the rotor shaft 52 on the motor shaft. This means that the end of the rotor 42 which is situated at the end-side 48 executes an eccentric movement about the longitudinal axis X, with a greater diameter than the end region of the rotor 42 at the end-side 50. Preferably, an eccentricity of the movement is no longer given at the axial end 54 of the rotor shaft which is connected to the motor shaft. At its end which is distant to the rotor 42, the rotor shaft 52 comprises a seal 56 which seals the space 58 which connects to the stator 40 to the motor on the pressure side.

Shoulder surfaces 60 are formed on the seal 56, which are distant to the rotor 42 and thus to the suction side on the end-side 48. Since these shoulder surfaces 60 are situated in the inside of the space 58, in which the pressure-side fluid pressure acts, the fluid pressure acts onto these shoulder surfaces 60, and produces a force in the direction of the longitudinal axis W of the rotor shaft 52, which presses the rotor shaft 52 with the rotor 42, towards the end-side 48 in the stator 40. In this manner, a pressing force between the rotor 42 and the stator 40 is produced by the fluid pressure at the pressure side, and this pressing force increases with an increasing fluid pressure on the pressure side of the pump, and reduces with a reducing fluid pressure. This with this embodiment too, an automatic setting of the fit and thus of the pressing force between the rotor 42 and the stator 40 is ensured on operation of the pump.

In the shown example, the rotor shaft is designed as one piece with the rotor 42, of a ceramic material, and in its inside comprises a cavity 62. The cavity 62 has a polygonal cross-sectional shape and is engaged at it face-end which is distant to the rotor 42, to a coupling element 64 which has a corresponding polygonal, outer cross-sectional shape. The coupling element 64 forms the axial end 54 of the rotor shaft 52. The coupling element 64 may be displaced axially in the inside of the cavity 62 in the direction of the longitudinal axis W. In this manner, an axial displaceability of the rotor shaft 52 or the rotor 42 relative to the stator 40 is achieved. Moreover, the coupling element 64 permits the eccentric movement of the rotor shaft 52 about a fictive joint point 65 on the middle axis of the coupling element 64. For this, the coupling element 64 is formed on an elastomer material, preferably rubber, or comprises a coating of an elastomer material or rubber at least on its region which faces the inside of the rotor shaft 52. This leads to an articulated mounting of the coupling element 64 in the cavity 62, in the inside of the rotor shaft 52. Thus the rotation shaft executes an eccentric movement about the coupling element 64 and the joint point 65 on account of the flexibility of the connection between the rotor shaft 52 and the coupling part 64.

The pressing force with which the rotor 42 presses into the stator 40, is sets automatically on account of the pressures at the suction side and pressure side of the rotor 42, as well as the pressure of the surroundings, and in particular on the basis of the force conditions between the pressure forces acting on the shoulder surfaces 60 as well as on the end-face of the rotor 42 at the axial side 48, and the pressure of the surroundings acting on the axial end 54. Additionally, here, a spring element 66 is provided in the region of the seal 56 and this produces a biasing of the rotor in the direction of the stator 40.

The stator 40 on its inner surface which faces the rotor 42, has a coating 68 of an elastomer material.

Figure 6:
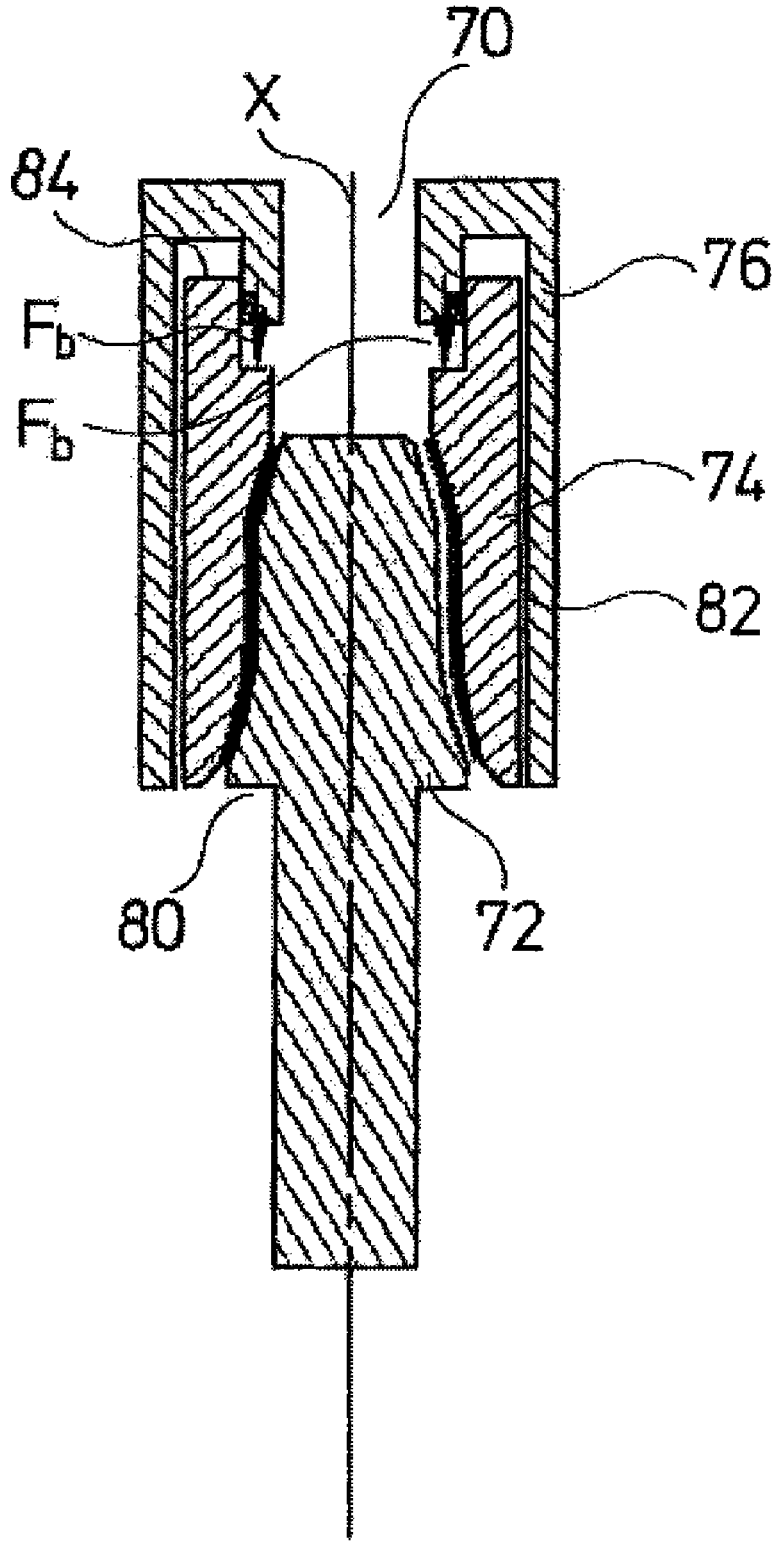

A further embodiment of an eccentric screw pump is described by way of FIG. 6. With this embodiment, in contrast to the two previously described embodiments, it is not the rotor, but the stator which is axially movably mounted.

The rotor 72 is arranged in the inside of a stator 74 as with the embodiment according to FIGS. 1 to 4. The stator 74 is movably guided in a housing 76 on the axial direction X, i.e. in the direction of the longitudinal axis of the stator 72.

The arrangement as is shown schematically in FIG. 6, is applied in a manner such that the suction side 70 of the pump is situated at the axial end of the conical rotor 72 with the smaller diameter. Thus the exit-side pressure of the eccentric screw pump bears on the end-face 80 at the axial side, wherein the rotor 72 is fixed by an axial bearing which is not shown. Then the pressure-side pressure may be led through a channel or gap 82 between the housing 76 and the stator 74, onto an end-face 84 of the stator 74, which faces the suction side 70 of the pump. Thus a pressure force is produce on this end-face 84, which presses the stator onto the rotor 72.

It is to be understood that for setting the fit or the pressing force between the rotor and stator, it is merely a question of the relative movement between the rotor and the stator. Thus the embodiments according to FIG. 6 and FIGS. 1 to 5 may be combined with one another, i.e. a rotor as well as a stator may be provided, on which the pressure prevailing on the pressure side of the pump acts in a manner such that the rotor and stator which are designed conically to one another in a complementary manner, are pressed against one another. With the shown embodiment examples, the rotor shaft which drives the rotor, is always arranged at that end of the conical rotor which has the greater diameter. The invention may however also be realized with an arrangement in which the rotor shaft is arranged at the end of the rotor with the smaller diameter.

Figure 7:
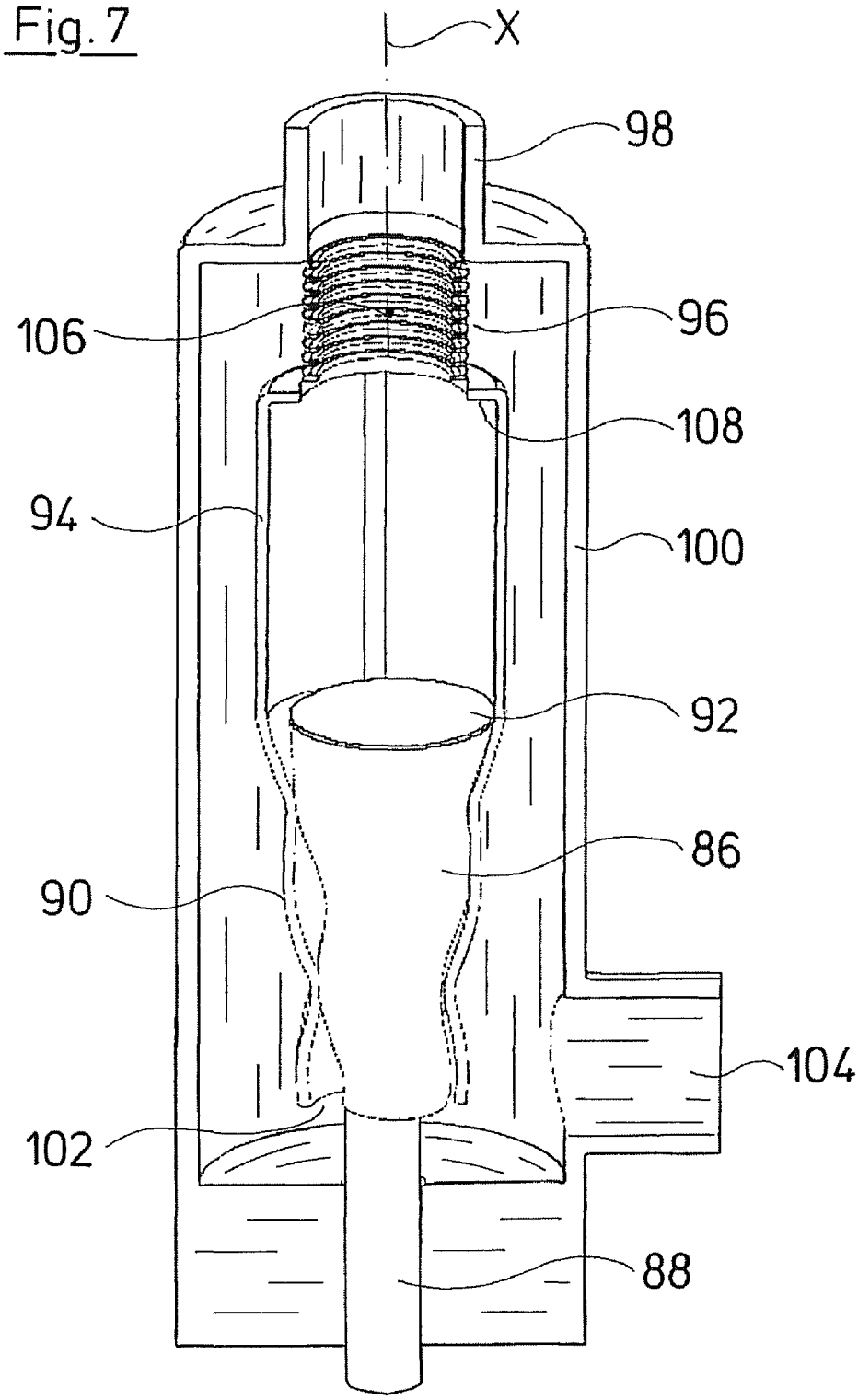

FIG. 7 shows an embodiment with which the rotor 86 driven by the rotor shaft 88 may execute a purely rotational movement. With this embodiment, the occurring eccentricity between the rotor 86 and the stator 90 given a rotation of the rotor 86 is compensated by a movement ability of the stator 90. Thus the stator 90 is part of a stator housing which is extended beyond the axial end-side 92 of the rotor 86. The extension 94 of the stator housing is designed in a tubular manner, and at its end which is distant to the rotor 86, merges into a bellows 96, which is connected to the pressure union 98 of the surrounding pump housing 100.

With the embodiment example shown in FIG. 7, the pressure side of the pump bears on the side of the rotor 86 and stator 90, which has the greatest cross section. I.e. the end 102 of the eccentric screw pump which is formed of the rotor 86 and the stator 90, forms the suction side of the pump which is in connection with the inside of the surrounding pump housing 100 and with a suction connection 104 which runs into this pump housing.

On operation of the pump, the rotor 86 executes a rotational movement about its longitudinal axis. The stator 90 with the connecting extension 94 simultaneously carries out an eccentric movement with respect to the longitudinal axis X, wherein the eccentric movement is made possible on account of the bellows 96 which forms a joint. A fictive joint point 106 about which the eccentric movement of the stator 90 is effected, is situated in the inside of the bellows 96 on the longitudinal axis X. Thereby, here too, the eccentric movement describes a path along a cone surface, wherein the joint point 106 forms the cone tip. I.e. the eccentricity is greatest at the face-end 102 of the stator 90, and is equal to zero in the joint point 106.

The inside of the extension 94 forms a pressure chamber in which the pressure-side pump pressure of the eccentric screw pump acts. Thereby, the pressure-side pressure on the one hand acts on the end-face 92 of the rotor 86, and simultaneously on the annular surface 108 which surrounds the bellows 96 and which is arranged in the inside of the pressure space formed by the extension 94. The rotor 86 thereby is fixed by way of an axial bearing which is not shown. The annular surface 108 thereby is arranged at the side of the extension 94, which is distant to the end-side 92 of the rotor 86, and on the rotor 86, i.e. faces the suction side of the pump. Since the suction-side pressure prevails in the inside of the pump housing 100, the suction pressure also bears on the outer wall of the extension 94, which is opposite to the annular surface 108, said pressure being lower than the pressure in the inside of the extension 94. In this manner, on account of the pressure in the inside of the extension 94, the stator 90 is pressed towards the pressure union 86, wherein the longitudinal compensation is effected by the bellows 96. Thus with this embodiment too, one may effect an automatic setting of the fit between the rotor 86 and the stator 90, in dependence on the pressure difference between the suction side and the pressure side of the eccentric screw pump.

LIST OF REFERENCE NUMERALS

2—drive motor
4—pump unit
6—entry opening
8—pressure union
10—stator
12—rotor
14—elastomer material
16, 18—end-sides
20—rotor shaft
22—articulation point
23—joint point
24—driven shaft
26—pressure surface
28—channel
30—bellows
32, 34—pressure space
36—separating wall
38—channel
40—stator
42—rotor
44—housing
46—suction opening
48, 50—end-sides
52—rotor shaft
54—axial end
56—seal
58—space
60—shoulder surfaces
62—cavity
64—coupling element
65—joint point
66—spring elements
68—coating
70—suction side
72—rotor
74—stator
76—housing
78—end-face
80—end-face
82—gap
84—end-face
86—rotor
88—rotor shaft
90—stator
92—end-side
94—extension
96—bellows
98—pressure union
100—pump housing
102—face-end
104—suction connection
106—joint point
108—annular surface
X—longitudinal axis of the stator
W—longitudinal axis of the rotor

The invention claimed is:

1. An eccentric screw pump with an annular outer part (10; 40; 74) and with an inner part (12, 42; 72) arranged therein, wherein an inside of the outer part (10; 40; 74) and an outside of the inner part (12; 42; 72) taper towards an axial side (16; 46; 70) in a complementary manner, and the inner part (12; 42; 72) and the outer part (10; 40; 74) are movably mounted relative to one another in an axial direction (X, W), wherein either the axial side to which the inside of the outer part (10; 74) and the outside of the inner part (12; 72) taper, is a pressure side of the eccentric screw pump, and the inner part (12) in its inside comprises a channel (28) which is open to the pressure side or to a cavity in the inside of the eccentric screw pump and is in connection with a surface (26) of the inner part (12), which is distant to the pressure side, by which means a pressure prevailing on the pressure side of the eccentric screw pump or in the inside of the eccentric screw pump between the inner part and the outer part (10, 40, 74), produces a force acting on the inner part (12; 42; 72) axially in a direction in which the inner part (12; 42; 72) tapers, or the axial side to which the inside of the outer part (40) and the outside of the inner part (42) taper, is a suction side (46) of the eccentric screw pump, and a pressure channel (82) is provided, which connects the pressure side or a cavity between the inner part (42) and the outer part (40) of the eccentric screw pump, to a surface (84) of the outer part, which is distant to the pressure side, by which means a pressure prevailing on the pressure side of the eccentric screw pump or in the inside of the eccentric screw pump between the inner part and outer part (10, 40, 74), produces a force acting on the outer part (10; 40; 74) axially opposite to the direction in which the inner part (12; 42; 72) tapers.

2. An eccentric screw pump according to claim 1, wherein it is designed in a manner such that the pressure prevailing at the pressure side acts on a surface of the inner part (12; 42), which is distant to a tapered end of the inner part (12; 42).

3. An eccentric screw pump according to claim 1 or 2, wherein a pressure space (32, 34) is arranged on the axial side of the inner part (12), which is distant to the pressure side and this pressure space is in connection with the channel (28)

and has a length which may be changed in the axial direction (W), as well as an inner surface (26) which is connected to a rotor (12) and is distant to the pressure side.

4. An eccentric screw pump according to claim 3, wherein the pressure space (32, 34) is formed in an inside of a shaft (20) driving the inner part (12), wherein the shaft (20) with the pressure space (32, 34) is changeable in its length.

5. An eccentric screw pump according to claim 3, wherein the pressure space (32, 34) is changed in its length by a piston-cylinder arrangement or by an outer wall which is elastic in the axial direction (W) or by a piston-cylinder arrangement and an outer wall which is elastic in the axial direction (W).

6. An eccentric screw pump according to claim 3, wherein a throttle location (38) is formed in the channel (28) or the pressure space (32, 34) which is in connection with the channel (28).

7. An eccentric screw pump according to claim 1, wherein the surface (26) which is distant to the pressure side and with which the channel (28) is in connection, is greater than an end-face (16) of the inner part (12), which faces the pressure side.

8. An eccentric screw pump according to claim 1, wherein at least one biasing element (30; 66) is provided, which impinges the inner part (12; 42; 72) with a biasing force in the axial direction (W), in which it tapers or which impinges the outer part (10; 40; 74) with a biasing force in an opposite axial direction (W) or which impinges the inner part (12; 42; 72) with a biasing force in the axial direction (W), in which it tapers and which impinges the outer part (10; 40; 74) with a biasing force in an opposite axial direction (W).

9. An eccentric screw pump according to claim 1, wherein the inner part (12; 42; 72) is connected to a drive motor (2) via a shaft (20; 52), wherein the shaft (20; 52) is articulately mounted in a joint point (23), and the joint point (23) is movable in a preferably purely rotational manner.

10. An eccentric screw pump according to claim 1, wherein the inner part (12; 42; 72) is connected to a drive motor (2) via a shaft (20; 52), and the shaft (20; 52) is eccentrically movable with the inner part (12; 42; 72), wherein the inner part (12; 42; 72) and the shaft (20; 52) are arranged in a manner such that the eccentricity of their movement increases proceeding from a joint point (23), in a substantially linear manner.

11. An eccentric screw pump according to claim 1, wherein the inner part (12; 42; 72) at least on its surface, is formed of a ceramic material, and the outer part (10; 40; 74) at least one a surface which faces the inner part, is formed of an elastomer.

12. An eccentric screw pump according to claim 4, wherein the pressure space (32, 34) is changed in its length by a piston-cylinder arrangement or by an outer wall which is elastic in the axial direction (W) or by a piston-cylinder arrangement and an outer wall which is elastic in the axial direction (W).

* * * * *